US006085358A

United States Patent [19]

Cogan

[11] Patent Number: 6,085,358

[45] Date of Patent: Jul. 11, 2000

[54] VISION ENHANCING TEAR OFF SHIELD GUARD

[76] Inventor: Kevin Cogan, 157 Algonquin Park, Plattsburgh, N.Y. 12979

[21] Appl. No.: 09/200,028

[22] Filed: Nov. 25, 1998

Related U.S. Application Data

[63] Continuation of application No. 08/863,369, May 27, 1997.

[51] Int. Cl.[7] ..... A42B 1/08; A61F 9/02

[52] U.S. Cl. ..... 2/424; 2/434

[58] Field of Search ..... 2/426, 6.4, 424, 2/432, 441, 443, 427, 434, 15; 351/47, 44, 57

[56] References Cited

U.S. PATENT DOCUMENTS

| | | | |
|---|---|---|---|
| 1,640,661 | 8/1927 | La Rocco . | |
| 2,759,394 | 8/1956 | Evans . | |
| 2,907,041 | 10/1959 | Finn . | |
| 3,945,044 | 3/1976 | McGee et al. | 2/14 H |
| 4,047,249 | 9/1977 | Booth | 2/10 |
| 4,076,373 | 2/1978 | Moretti . | |
| 4,138,746 | 2/1979 | Bergman | 2/424 |
| 4,455,689 | 6/1984 | Boyer | 2/434 |
| 4,716,601 | 1/1988 | McNeal | 2/434 |
| 4,729,650 | 3/1988 | Jennings | 351/47 |
| 5,131,101 | 7/1992 | Chin | 2/424 |
| 5,592,698 | 1/1997 | Woods | 2/424 |
| 5,617,153 | 4/1997 | Allen et al. | 2/424 |
| 5,671,483 | 9/1997 | Reuber | 2/434 |
| 5,685,022 | 11/1997 | Essman et al. | 2/434 |
| 5,694,192 | 12/1997 | Lucki et al. | 2/434 |

*Primary Examiner*—John J. Calvert
*Assistant Examiner*—Shirra L. Jenkins
*Attorney, Agent, or Firm*—Randall L. Reed

[57] ABSTRACT

A vision enhancing tear off shield guard system for use with the visor of a racing helmet. One of the shield guard being tinted for vision enhancement under specific lighting conditions and adapted for engaging and fitting over the visor of a helmet. The shield guard also has a mechanism for quick release from the helmet. Several clear shield guards are stacked on the visor with the tinted shield guard in between to allow for changing lighting conditions.

8 Claims, 1 Drawing Sheet

VISION ENHANCING TEAR OFF SHIELD GUARD

This application is a Continuation Application of application Ser. No. 08/863,369 filed May 27, 1997.

FIELD OF INVENTION

The invention relates to racing helmets and visors. More particularly it relates to an apparatus and method which allows a race car driver to quickly adjust to changing ambient lighting conditions during a race.

BACKGROUND

In auto racing a driver typically wears a helmet with a visor to protect the drivers eyes. The visor is particularly important when the vehicle has no front windshield. In many forms of auto racing the vehicle operates without the front windshield including the following categories: formula 1, formula atlantic, stock car racing, Indy type races etc. Without the windshield during a race the visor can become covered with dirt and grime. Thus the driver needs some way to keep the visor clean during a race without having to stop to clean his visor and lose precious time. A common practice used in auto racing for at lest the last 10 to 15 years consists of securing several thin flexible plastic visor tear off shields guards over the front of the visor on the drivers helmet. The tear off shield guards have a tab at one end to allow the driver to tear off each successive shield guard during the race, without having to slow down or stop during the race.

Being able to see the surface definition of a race track is extremely important during a race. The driver must be able to identify slippery areas of the track and breaking points in the curves of the track. Braking points are physical features of a race track which a driver will use to assist in turning in a curve, to brake or to perform some other maneuver which requires, or can be enhanced by a friction point. Among the different types of braking points are cracks in the pavement, rough spots or some other physical feature. To maximize the advantage such a feature offers the driver must be able to clearly see the feature each time he approaches it, generally at a very high rate of speed, in order to properly position his vehicle to take maximum advantage of the feature.

In order to enhance visual acuity to better see the surface definition of the race track, up to the present the driver only had the option of wearing specially tinted glasses under his helmet or wearing a visor tinted for the ambient lighting conditions at the start of the race. If it was raining and over cast them a visor or glasses with an amber tint could be used or if it was sunny a visor or glasses with a grey or smoky tint would prove helpful.

However, if lighting conditions changed during the race such as form cloudy to sunny or visa versa the driver lost the advantage which the particular tinted visor or glasses provided and in fact put the wearer at a disadvantage. For instance, a visor with an amber tint while enhancing vision under cloudy or overcast conditions actually obstructs visual acuity under sunny conditions by making the surface of the tack to bright and shiny and thus washing out the distinguishing features. Add to this the fact that in any race time is every thing and either the format of the race does not allow for pit stops during the race, or the luxury of a pit stop at anytime to change your visor without loss of position or time. In addition changing the whole visor on a helmet in itself creates its own problems in that during the hectic minute or two of a pit stop the driver runs the risk of damaging the helmet or not properly making the change.

Sometimes it can take up to 20 minutes to properly make the change of a visor with all of the adjustments that have to be made. Also most racing drivers have a special helmet they wear so it is not possible, generally to merely change the helmet.

SUMMARY OF THE INVENTION

The present invention address the above noted problems of adapting to changing lighting conditions during a race without loss of time or position by providing vision enhancing tear off shield guards which can be easily removed by a driver during a race without having to slow down or stop.

It is a further object of this invention to provide differently tinted shield guards which will allow a driver to adapt to various lighting conditions which maybe encountered during a race yet readily adapt when those lighting conditions change.

The limitations of the prior art are thus overcome and the objects of the invention achieved through provision of vision enhancing tear off shield guards tinted for enhancing vision under various ambient lighting conditions but which can be easily removed in response to changes in the ambient lighting conditions during a race without slowing down or stopping.

BRIEF DESCRIPTION OF THE DRAWINGS

The foregoing and other objects, features and advantages of the invention will be apparent from the following more particular description of the preferred embodiments of the invention, as illustrated in the accompanying drawings in which.

DESCRIPTION OF THE PREFERRED EMBODIMENT

Figure 1:
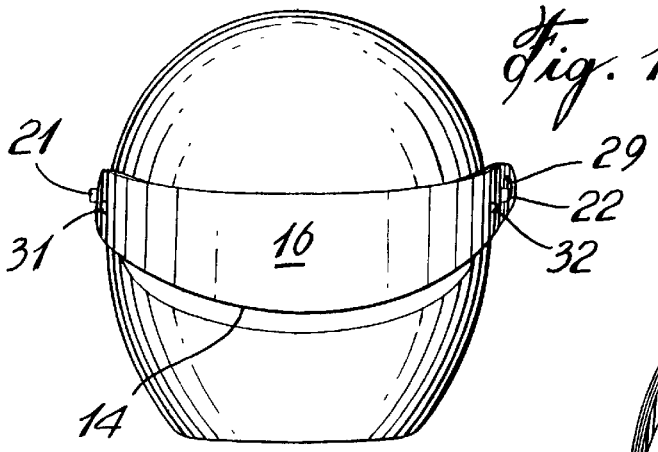
FIG. 1 is a face view of a racing helmet with visor down and tear off shield guard attached to the visor.
Figure 2:
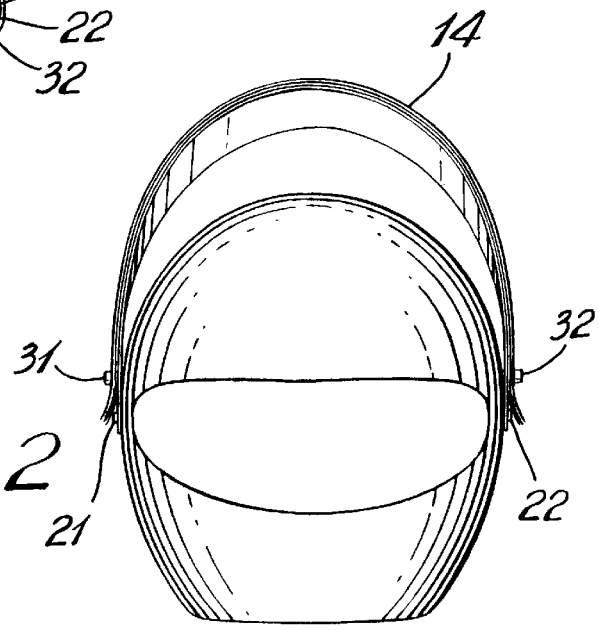
FIG. 2 depicts a helmet with the visor in the up position and tear off shield guard attached to the visor.
Figure 3:
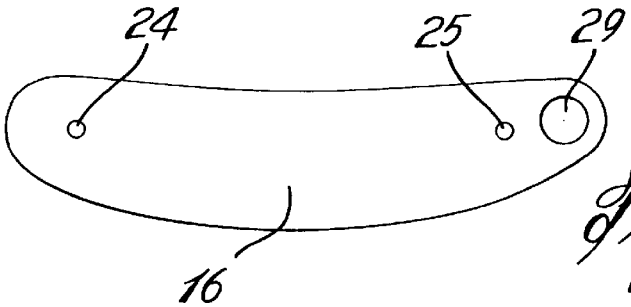
FIG. 3 depicts a view of the tear off shield guard laid out flat.

FIG. 1 depicts a standard racing helmet 12 with visor 14. Visor 14 connects to the helmet at points 21 and 22 in a manner well known to those skilled in the art. Points 21 and 22 form pivot points which allow the helmet user to push the visor 14 up and a way from the eyes as depicted in FIG. 2. FIG. 3 shows the standard visor tear off shield guard 16 with connecting holes 24 and 25 at either end. Tear off grip 29 is located just beyond one of the connecting holes. Connecting holes 24 and 25 fit over connecting posts 31 and 32 on the visor 14. Several of these visor tear off shield guards 16 are placed on the visor and secured to the connecting posts 31 and 32. The tear off grips 29 then extend beyond the adjacent securing post. Thus, during the race when a driver needs to change or remove a visor shield guard, he merely has to reach up with one hand and grab the tear off grip 29 of the top most visor shield guard, pull it forward and away from his helmet. The drivers other hand remains safely on the steering wheel during the whole process.

The thin flexible plastic like material which makes up the visor tear off shield guard 16 allows one to fit it over the curved surface of the visor 14 or to lay it out flat as depicted in FIG. 3. The visor 14 is generally made up of a hard very rigid clear plastic or plastic like material.

Typically, the shield guards 16 are made of a clear transparent plastic or a similar clear resilient material. The practice of this invention tints at least one of the shield guards placed over visor 14 to enhance visual acuity under varying ambient lighting conditions. Generally for cloudy or overcast days the shield guard 16 is tinted amber to allow the driver to more clearly see the definition of the track. The amber tint under these conditions makes everything appear brighter and also filter out certain wave lengths of light so that features such as slight variations in the track more clearly stand out. For sunny conditions a grey, green, smokey or brown tint provides the best vision enhancement. It has also been found that a purple tint enhances vision under sunny and lighting conditions in between sunny and overcast.

Figure 4:
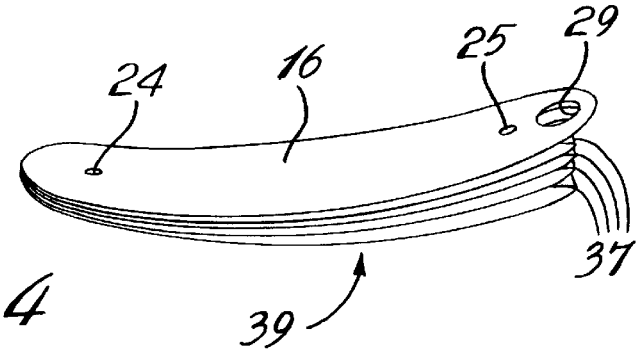
FIG. 4 is a perspective view of a stack of tear off shield guards.

In practice, especially when the car has no windshield, a stack of several shield guards 39 FIG. 4 are placed over the visor 14 FIGS. 1 and 2. In the preferred embodiment the stack 39 only has one tinted shield guard the rest being clear and completely transparent. Also in the preferred embodiment the tinted shield guard is placed at or near the center of the stack 39. Placement of the tinted shield guard at or near the center of the stack provides one or more clear shield guards on either side of the tinted one. Thus whether or not the driver has to remove the tinted guard in response to changing lighting conditions he has several clear ones to remove as needed. Naturally, more than one tinted shield guard can be included in stack 39 and the same effect would be achieved.

A common practice know by those skilled in the art is to tuck the tear off tab 29 of all but the top one back into the stack onto and adjacent surface of the that shield guard. The tear off tab is folded back onto itself 37 in such a fashion well know in the industry such that, as each shield guard at the top of the stack is torn off the tear off tab 29A of the next shield guard unfolds out, ready to allow that shield guard to be torn off when the need arises.

While the invention has been particularly shown and described with reference to a preferred embodiment thereof, it will be understood by those skilled in the art that various changes in form and detail may be made therein without departing from the spirit and the scope of the invention.

I claim:

1. Vision enhancing tear off shield guard system for use with a visor and racing helmet comprising:

a plurality of clear transparent tear off shield guards made of thin flexible material and at least one transparent tear off shield guard tinted for vision enhancement under specific lighting conditions, the plurality of clear tear off shield guards and the at least one tinted tear off shield guard being joined together to form a stack;

a helmet, a visor adapted to attach to the helmet, the tear off shield guards formed into a stack are adapted to detachably fit over the visor in a close fit with the visor such that they can be easily removed one at a time with the movement of one hand, the at least one tear off shield guard tinted for vision enhancement is positioned with at least one clear tear off shield guard on either side of it and whereby the at least one tinted tear off shield guard can be removed in response to changing lighting conditions with the movement of one hand of a driver while a second hand of the driver remains on a steering wheel during operation of a vehicle in a race.

2. The tear off shield system of claim 1 with at least one untinted transparent tear off shield placed adjacent to the tinted tear off shield.

3. The system of claim 1 wherein the tinted shield guard is tinted amber.

4. The system of claim 1 wherein the shield guard is tinted a dark tint for sunny lighting conditions.

5. The system of claim 1 wherein the shield guard is tinted purple.

6. A method for providing easily modified vision enhancement for a racing helmet comprising:

providing a helmet with a visor;

attaching to the visor a plurality of clear thin transparent tear off shield guards to protect the visor and at least one tear off shield guard tinted for vision enhancement under specific lighting conditions;

position said at least one tear off shield guard, tinted for vision enhancement, between two clear tear off shield guards;

providing means to quickly release, one at a time, the plurality of clear tear off shield guards and at least one tinted tear off shield guard from the visor with one hand when the visor is attached to the helmet and the helmet is being worn by a driver;

removing during a race by the driver the tinted tear off shield guard with one hand in response to changing lighting conditions while a second hand of the driver remains on a steering wheel of a vehicle the driver is operating during the race; and whereby the driver can safely adapt to changing lighting conditions during the race while operating the vehicle.

7. The method of claim 6 comprising the additional step of removing the tear off shield with one hand to adapt to changing lighting conditions.

8. A system for protection of a visor of a helmet and vision enhancement under changing lighting conditions, said system comprising a plurality of clear tear off shield guards and at least one vision enhancing tear off shield guard for use with a visor and helmet, said vision enhancing tear off shield guard being tinted for vision enhancement under specific lighting conditions, the plurality of clear tear off shield guards and at least one vision enhancing tear off shield guard being adapted to engage and fit over a visor of a helmet and wherein said vision enhancing tear off shield, tinted for vision enhancement, is positioned between at least two clear tear off shield guards, further each having a mechanism for individual quick release from the visor while the helmet is being worn by a driver of a vehicle during a race, and whereby the tear off shield guard tinted for vision enhancement can be removed in response to changing lighting conditions with the movement of one hand of the driver while a second hand of the driver remains on a steering wheel during operation of the vehicle in a race.

* * * * *